US008200123B2

(12) United States Patent
Goda et al.

(10) Patent No.: US 8,200,123 B2
(45) Date of Patent: Jun. 12, 2012

(54) IMAGE FORMING APPARATUS AND IMAGE FORMING UNIT

(75) Inventors: Mitsuhiro Goda, Osaka (JP); Naoki Yamane, Osaka (JP)

(73) Assignee: Kyocera Mita Corporation (JP)

( * ) Notice: Subject to any disclaimer, the term of this patent is extended or adjusted under 35 U.S.C. 154(b) by 435 days.

(21) Appl. No.: 12/547,542

(22) Filed: Aug. 26, 2009

(65) Prior Publication Data

US 2010/0054792 A1 Mar. 4, 2010

(30) Foreign Application Priority Data

Aug. 27, 2008 (JP) ..... 2008-218230

(51) Int. Cl.
*G03G 15/00* (2006.01)
*G03G 21/06* (2006.01)
*G03G 21/00* (2006.01)

(52) U.S. Cl. ..... 399/128; 399/349

(58) Field of Classification Search ..... 399/128, 399/129, 99, 349
See application file for complete search history.

(56) References Cited

U.S. PATENT DOCUMENTS

| | | | | |
|---|---|---|---|---|
| 3,754,137 | A * | 8/1973 | Kamogawa et al. | |
| 4,201,465 | A * | 5/1980 | Oyama et al. | 399/129 |
| 4,351,603 | A * | 9/1982 | Tagawa | 399/129 |
| 4,408,865 | A * | 10/1983 | Camis et al. | 399/128 |
| 4,462,682 | A * | 7/1984 | Monma | 399/99 |
| 4,699,494 | A * | 10/1987 | Honda | 399/128 |
| 4,750,019 | A * | 6/1988 | Kamitani | 399/128 |
| 4,785,324 | A * | 11/1988 | Yamazaki et al. | 399/128 |
| 5,099,271 | A * | 3/1992 | Maeda et al. | |
| 7,031,641 | B2 * | 4/2006 | Nakahara et al. | 399/129 |
| 2007/0036577 | A1 * | 2/2007 | Okabe et al. | |
| 2007/0258727 | A1 * | 11/2007 | Shinoda | |

FOREIGN PATENT DOCUMENTS

JP 2000-293090 10/2000

* cited by examiner

*Primary Examiner* — Susan Lee
(74) *Attorney, Agent, or Firm* — Gerald E. Hespos; Michael J. Porco

(57) ABSTRACT

An image forming apparatus is provided with an image bearing member for bearing a toner image while rotating, a toner image forming device for forming the toner image on the image bearing member, a neutralizer for neutralizing electric charges on the image bearing member by irradiating light to the charged image bearing member after the toner image formed on the rotating image bearing member is transferred to a transfer material, and a frame for supporting the neutralizer. A first clearance is present between the neutralizer and the frame.

15 Claims, 8 Drawing Sheets

IMAGE FORMING APPARATUS AND IMAGE FORMING UNIT

BACKGROUND OF THE INVENTION

1. Field of the Invention

The present invention relates to an image forming apparatus and an image forming unit which can be employed in this image forming apparatus.

2. Description of the Related Art

There has been known an image forming apparatus employed as a copier, a printer and further a facsimile machine. The image forming apparatus of this type forms an electrostatic latent image on the circumferential surface of a photoconductive drum (image bearing member) based on image information read or transmitted from an external computer or the like. The image forming apparatus causes a developing device to supply toner toward the electrostatic latent image on the circumferential surface of the photoconductive drum, thereby forming a toner image on this circumferential surface and transfers this toner image to a sheet.

Such an image forming apparatus includes a neutralizer for neutralizing electric charges remaining on the circumferential surface of the photoconductive drum after an image transferring process to a sheet or a transfer member such as a transfer belt. The circumferential surface of the image bearing member where no electric charges are present due to the neutralization by the neutralizer heads for a charger at a downstream side, where a charging process is applied as a preparation for forming a new electrostatic latent image.

The neutralizer normally includes a substrate formed with a specified circuit and a light emitting member such as an LED (light emitting diode) attached to this substrate for obtaining power from the circuit. Accordingly, upon receiving the supply of power, the circuit and the light emitting member generate heat, whereby a negative influence may be exerted on surrounding devices due to a temperature increase. Specifically, scattered toner may attach to the surrounding devices whose temperatures have risen such as a driving mechanism to be melted and may, thereafter, be solidified to hinder normal driven states of the surrounding devices. If this occurs, a normal image forming process can be no longer performed to cause an image failure.

In order to solve such a problem, an image forming apparatus disclosed in Japanese Unexamined Patent Publication No. 2000-293090 includes a cooling device provided with a circulating air duct constructed to include a neutralizer, a fan installed in this circulating air duct and a heat pipe for cooling an air stream circulating in the circulating air duct by the driving of the fan by heat exchange.

By employing such a cooling device, heat generated in the neutralizer is removed by heat exchange with the air stream circulating in the circulating air duct by the driving of the fan. In this way, the air stream whose temperature has risen is cooled by the heat pipe and circulates in the duct. Since the neutralizer is cooled by doing so, negative influence caused by the heat generation of the neutralizer is eliminated.

However, with the cooling device disclosed in patent literature 1, the large circulating air duct, fan, heat pipe and the like have to be provided in the image forming apparatus, which causes a cost increase of the apparatus.

Accordingly, in order to solve this problem, such a long frame as to horizontally cross an apparatus body is mounted in an image forming apparatus and a specified number of neutralizers are juxtaposed atop this frame in some cases. By doing so, heat generated by the neutralizers is radiated after being transferred to the frame with a large heat radiation area, wherefore it is expected to effectively suppress temperature increases of the neutralizers.

However, an expected cooling effect cannot be obtained simply by providing the long frame and mounting the neutralizers on the frame. Therefore, a further improvement is expected.

SUMMARY OF THE INVENTION

An object of the present invention is to provide an image forming apparatus suppressing temperature increase of the neutralizer and its surrounding devices, and an image forming unit which can be employed in this image forming apparatus.

One aspect of the present invention which accomplishes this object is directed to an image forming apparatus, comprising an image bearing member for bearing a toner image while rotating; a toner image forming device for forming the toner image on the image bearing member; a neutralizer for neutralizing electric charges on the image bearing member by irradiating light to the charged image bearing member after the toner image formed on the rotating image bearing member is transferred to a transfer material; and a frame for supporting the neutralizer, wherein a first clearance is present between the neutralizer and the frame.

According to this construction, heat generated by power application to the neutralizer is transferred to an air layer in the first clearance present between the neutralizer and the frame supporting the neutralizer and removed by the convection of the air layer. Thus, temperature increases of the neutralizer and its surrounding devices are more effectively suppressed as compared with the case where the entire lower surface of the neutralizer is merely supported in close contact with the frame and the neutralizer is cooled only by heat transfer.

These and other objects, features and advantages of the present invention will become more apparent upon a reading of the following detailed description with reference to accompanying drawings.

BRIEF DESCRIPTION OF THE DRAWINGS

FIG. 5 is a cross-sectional diagram along V-V of FIG. 4, FIGS. 6A and 6B are perspective views, partly cut away, showing one embodiment of a side sealing member, wherein

DETAILED DESCRIPTION OF THE PREFERRED EMBODIMENT

Figure 1:
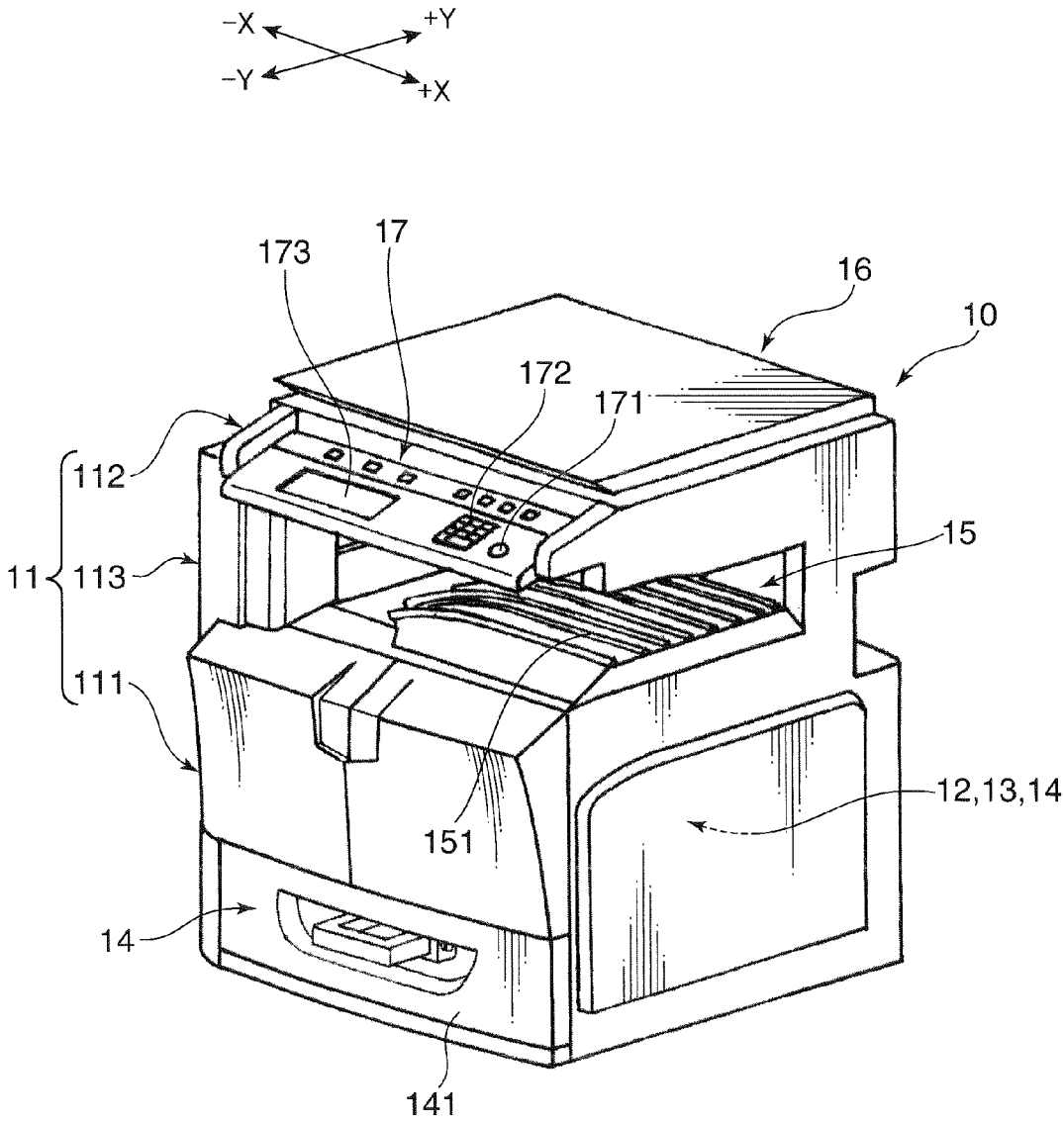
FIG. 1 is a perspective view showing one embodiment of an image forming apparatus according to the invention.
Figure 2:
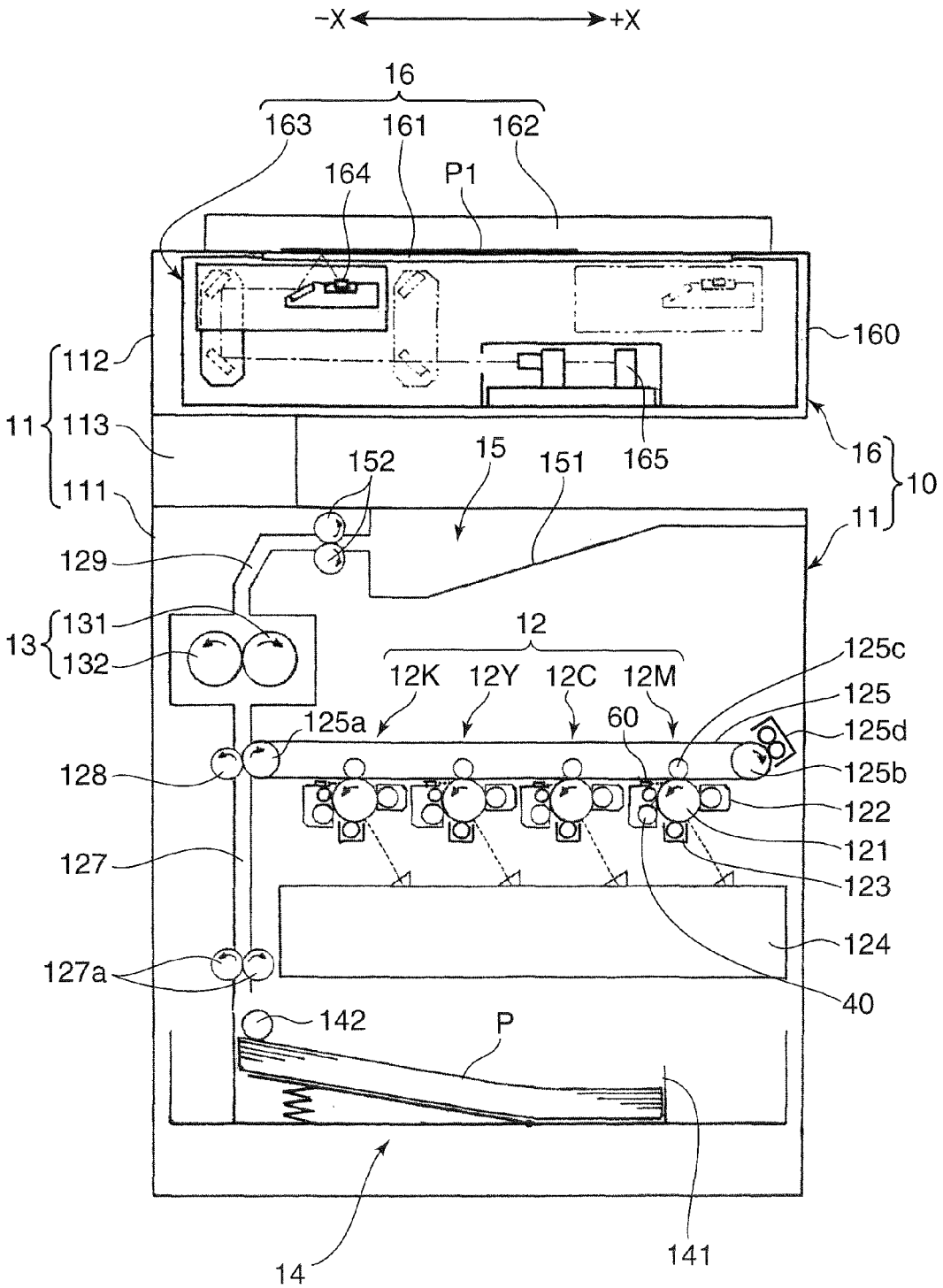
FIG. 2 is a front view in section showing an internal construction of the image forming apparatus shown in FIG. 1.

In FIGS. 1 and 2, X-X directions indicate leftward and rightward directions, wherein −X direction indicates leftward direction and +X direction indicates rightward direction, and Y-Y directions indicate forward and backward directions, wherein −Y direction indicates forward direction and +Y direction indicates backward direction.

First of all, an image forming apparatus 10 shown in FIG. 1 is a copier of the so-called internal discharge type, wherein an image forming station 12, a fixing unit 13, a sheet storing unit 14, a discharge unit 15, an image reading unit 16 and an operation unit 17 are respectively formed in an apparatus body 11. In the image forming apparatus 10, the discharge unit 15 is formed by partly indenting the apparatus body 11 below the image reading unit 16. This image forming apparatus 10 is called to be of the internal discharge type because the discharge unit 15 is formed by partly indenting the apparatus body 11 in this way.

The apparatus body 11 includes a lower body 111 having a rectangular parallelepipedic outer shape, an upper body 112 having a flat rectangular parallelepipedic outer shape and facing the lower body 111 from above, and a connecting body 113 interposed between the upper and lower bodies 112, 111. The connecting body 113 is a structure for connecting the lower and upper bodies 111, 112 with each other with the discharge unit 15 formed between the lower and upper bodies 111, 112, and stands from a left part of the lower body 111. The upper body 112 has a left part thereof supported on the upper end of the connecting body 113.

The image forming station 12, the fixing unit 13 and the sheet storing unit 14 are installed in the lower body 111, and the image reading unit 16 is installed in the upper body 112. The operation unit 17 projects forward from a front edge portion of the upper body 112 in this embodiment.

The discharge unit 15 is formed between the lower and upper bodies 111, 112. Such a discharge unit 15 includes an internal discharge tray 151 formed on the upper surface of the lower body 111, and a sheet P having a toner image transferred thereto in the image forming station 12 is discharged from a lower part of the connecting body 113 toward this internal discharge tray 151.

The image forming station 12 is described below with reference to FIG. 2. The image forming station 12 is for forming a toner image on a sheet P fed from the sheet storing unit 14 and includes a magenta image forming part 12M, a cyan image forming part 12C, a yellow image forming part 12Y and a black image forming part 12K successively arranged from an upstream side (right side) toward a downstream side as shown in FIG. 2.

Each of the image forming parts 12M, 12C, 12Y and 12K includes a photoconductive drum (image bearing member) 121 and a developing device (toner image forming device) 122. Toner is supplied to each photoconductive drum 121 from a corresponding developing device 122 while the photoconductive drum 121 is rotated in a counterclockwise direction in FIG. 2. Each developing device 122 is replenished with toner from an unillustrated corresponding toner cartridge arranged at a front side of the apparatus body 11 (front side with respect to the plane of FIG. 2).

Chargers 123 are disposed at positions right below the respective photoconductive drum 121, and exposure devices 124 are disposed at positions further below the respective chargers 123. The circumferential surfaces of the respective photoconductive drums 121 are uniformly charged by the chargers 123. The respective exposure devices 124 irradiate laser beams corresponding to the respective colors based on image data read by the image reading unit 16 to the charged circumferential surfaces of the photoconductive drums 121, thereby forming electrostatic latent images on the circumferential surfaces of the photoconductive drums 121. Toners are supplied from the developing devices 122 to such electrostatic latent images, whereby toner images are formed on the circumferential surfaces of the photoconductive drums.

A transfer belt 125 is so arranged at a position above the photoconductive drums 121 as to be held in contact with the respective photoconductive drums 121. This transfer belt 125 is mounted between a drive roller 125*a* disposed at a left position of FIG. 2 and a driven roller 125*b* disposed at a right position of FIG. 2.

Such a transfer belt 125 is rotated between the drive roller 125*a* and the driven roller 125*b* in synchronism with the respective photoconductive drums 121 while being pressed against the circumferential surfaces of the photoconductive drums 121 by transfer rollers 125*c* disposed in correspondence with the respective photoconductive drums 121.

Accordingly, as the transfer belt 125 is rotated, the following image transfers are performed. First of all, a magenta toner image is transferred to the outer surface of the transfer belt 125 by the photoconductive drum 121 of the magenta image forming part 12M. Successively, a cyan toner image is transferred to the same position of the transfer belt 125 in a superimposition manner by the photoconductive drum 121 of the cyan image forming part 12C. Then, a yellow toner image is transferred to the same position of the transfer belt 125 in a superimposition manner by the photoconductive drum 121 of the yellow image forming part 12Y. Finally, a black toner image is transferred in a superimposition manner by the photoconductive drum 121 of the black image forming part 12K.

A color image is formed on the outer surface of the transfer belt 125 by the above image transfers. The color image formed on the outer surface of the transfer belt 125 is transferred to a sheet P conveyed from the sheet storing unit 14.

Neutralizers 60 for neutralizing electric charges present on the circumferential surface of the photoconductive drum 121 after the image transferring process to set a potential to "±0" are disposed at positions to the upper left of each photoconductive drum 121 and right below the transfer belt 125. The circumferential surface of each photoconductive drum 121 passes the corresponding neutralizers 60 to set the potential thereof to "±0", thereby entering a state where a proper charging process by the charger 123 can be performed.

A drum cleaner 40 for cleaning the circumferential surface of each photoconductive drum 121 by removing residual toner is provided at a position right below the corresponding neutralizers 60 and to the left of the photoconductive drum 121 in FIG. 2. The circumferential surface of each photoconductive drum 121 cleaned by the drum cleaner 40 heads for the charger 123 for a new charging process.

Waste toner removed from the circumferential surface of the photoconductive drum 121 by each drum cleaner 40 is collected into an unillustrated toner collection bottle via a specified path.

A vertically extending sheet conveyance path 127 is provided at a position to the left of the image forming station 12. A pair of conveyor rollers 127*a* are disposed at a specified position of this sheet conveyance path 127, and a sheet P from the sheet storing unit 14 is conveyed toward the transfer belt 125 mounted on the drive roller 125*a* by driving this pair of conveyor rollers 127*a*.

A second transfer roller 128 held in contact with the outer surface of the transfer belt 125 is disposed at a position of the sheet conveyance path 127 facing the drive roller 125*a*. The sheet P is pressed between the transfer belt 125 and the second transfer roller 128 while being conveyed along the sheet conveyance path 127, whereby the toner image on the transfer belt 125 is transferred to the sheet P.

A belt cleaner 125*d* for removing residual toner remaining on the outer surface of the transfer belt 125 is disposed to the right of the transfer belt 125. The transfer belt 125 having finished with the transferring process to the sheet P is rotated for a next transferring process after being cleaned by having the residual toner on the outer surface removed by this belt cleaner 125*d*.

The fixing unit 13 is for fixing the toner image transferred to the sheet P in the image forming station 12 to the sheet P and includes a fixing roller 131 internally fitted with an electrical heating element such as a halogen lamp as a heat source inside, and a pressure roller 132 arranged to face the fixing roller 131 from the left side. The sheet P finished with the transferring process and introduced from the image forming station 12 via the second transfer roller 128 is heated by the fixing roller 131 while being pressed between these fixing roller 131 and pressure roller 132, whereby the toner image is fixed and a stable color image is formed on the sheet P.

The color printed sheet P finished with the fixing process passes along a discharge conveyance path 129 extending upward from the fixing unit 13 to be discharged toward the internal discharge tray 151 via a pair of discharge rollers 152.

The sheet storing unit 14 includes a sheet tray 141 detachably mounted at a position below the exposure devices 124 in the apparatus body 11. A bundle of sheets is stored in the sheet tray 141. Sheets P are dispensed one by one from this bundle of sheets stored in the sheet tray 141 by driving a pickup roller 142 and introduced to the image forming station 12 via the sheet conveyance path 127.

The image reading unit 16 includes a contact glass 161 which is mounted in an opening formed in the upper surface of the upper body 112 and on which a document P1 is placed with a document surface faced down, a document pressing mat 162 openable and closeable with respect to the contact glass 161 to press the document placed on the contact glass 161 and an optical unit 163 installed in the upper body 112 to read a document image of the document P1 placed on the contact glass 161.

The optical unit 163 scans the document surface from below via the contact glass 161 by a movement of a light source 164 with the document placed on the contact glass 161 pressed by the document pressing member 162. The optical unit 163 receives reflected light from the document surface by a CCD (charge coupled device) 165, thereby reading the document image. Document image information read by the CCD 165 is outputted to the exposure devices 124 of the image forming station 12 after being digitized.

The operation unit 17 is operated to enter various items (sheet size, number of sets to be processed, etc.) concerning the image forming process. As shown in FIG. 1, such an operation unit 17 includes a start key 171, a numeric keypad 172 used to enter numerical information, an LCD (liquid crystal display) 173 for displaying input information actually entered using the numeric keypad 172, error messages, etc. and the like.

In this embodiment, the photoconductive drum 121, the charger 123, the drum cleaner 40, the neutralizers 60, a cooling structure 70 to be described later for cooling a lubricant applicator 50 to be described later and the neutralizers 60, and the like are unitized into a drum unit 20 in the image forming apparatus 10 constructed as above. Such drum units 20 are described below with reference to FIGS. 3 to 5.

The drum unit 20 constructed to deal with the toner of each color is provided in each of the image forming parts 12M, 12C, 12Y and 12K. These respective four drum units 20 are structurally identical while differing only in the type of toner to be used.

Figure 3:
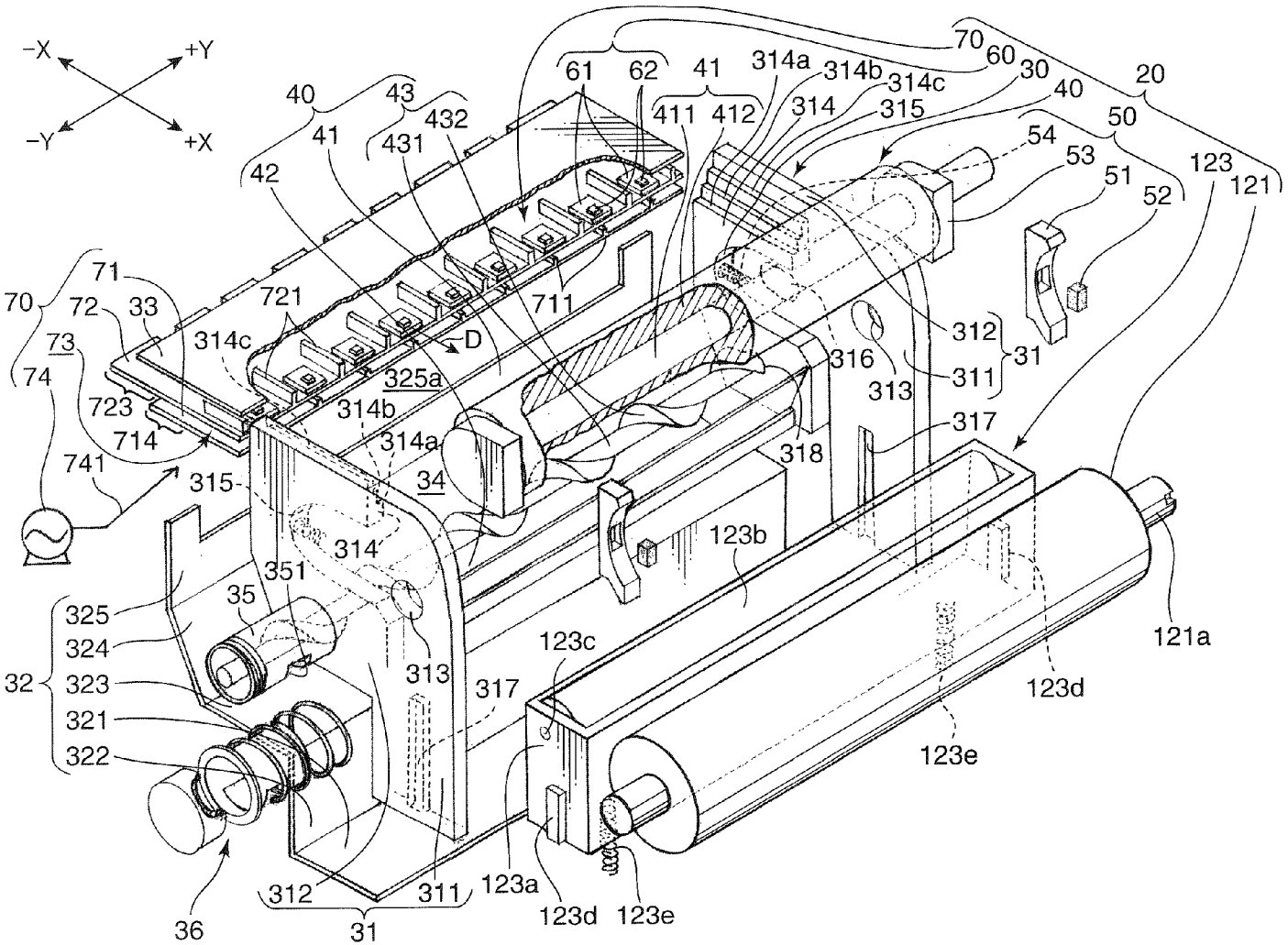
FIG. 3 is an exploded perspective view, partly cut away, as a principle diagram showing one embodiment of a drum unit.
Figure 4:
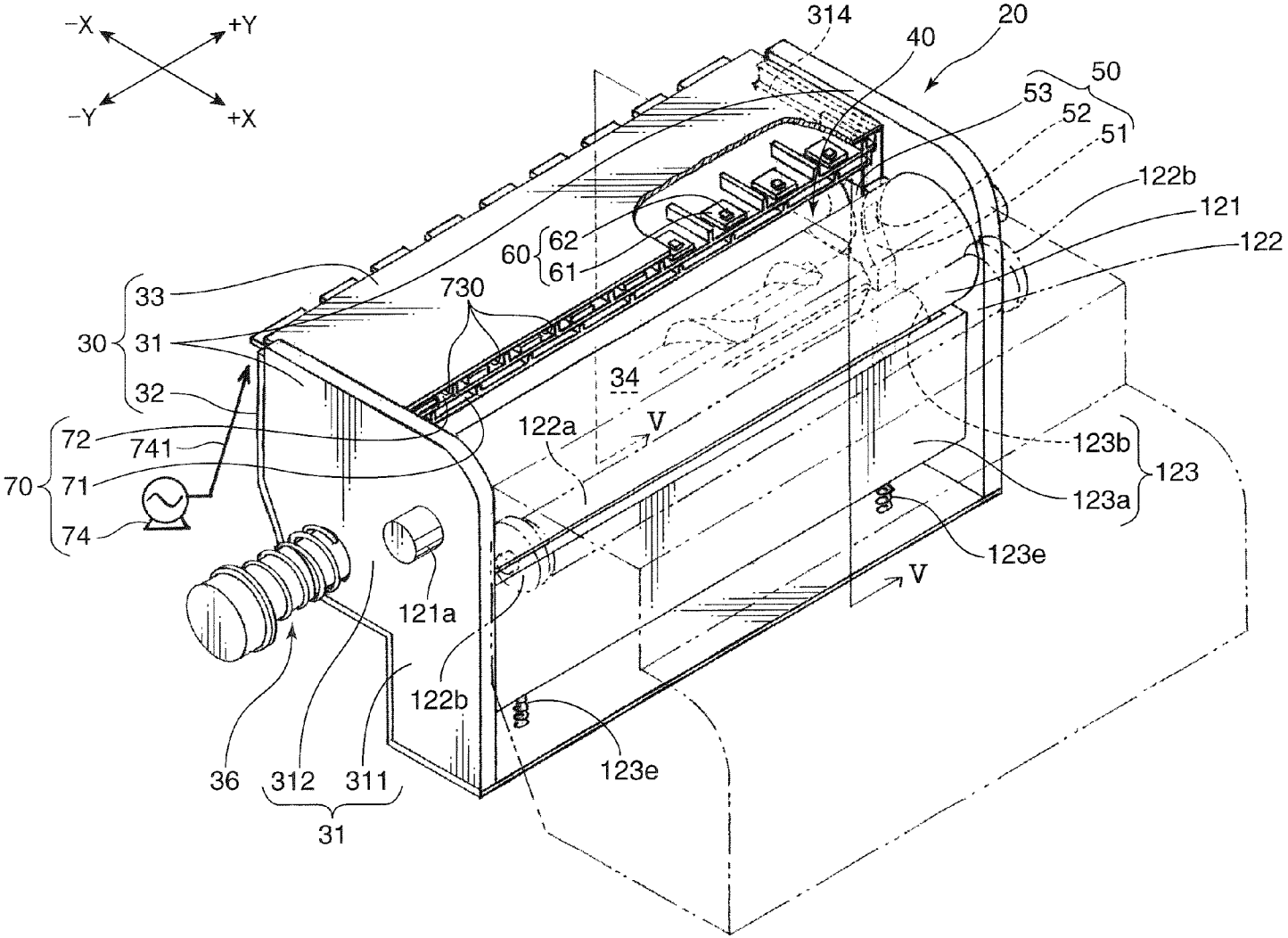
FIG. 4 is an assembled perspective view of the drum unit of FIG. 3.
Figure 5:
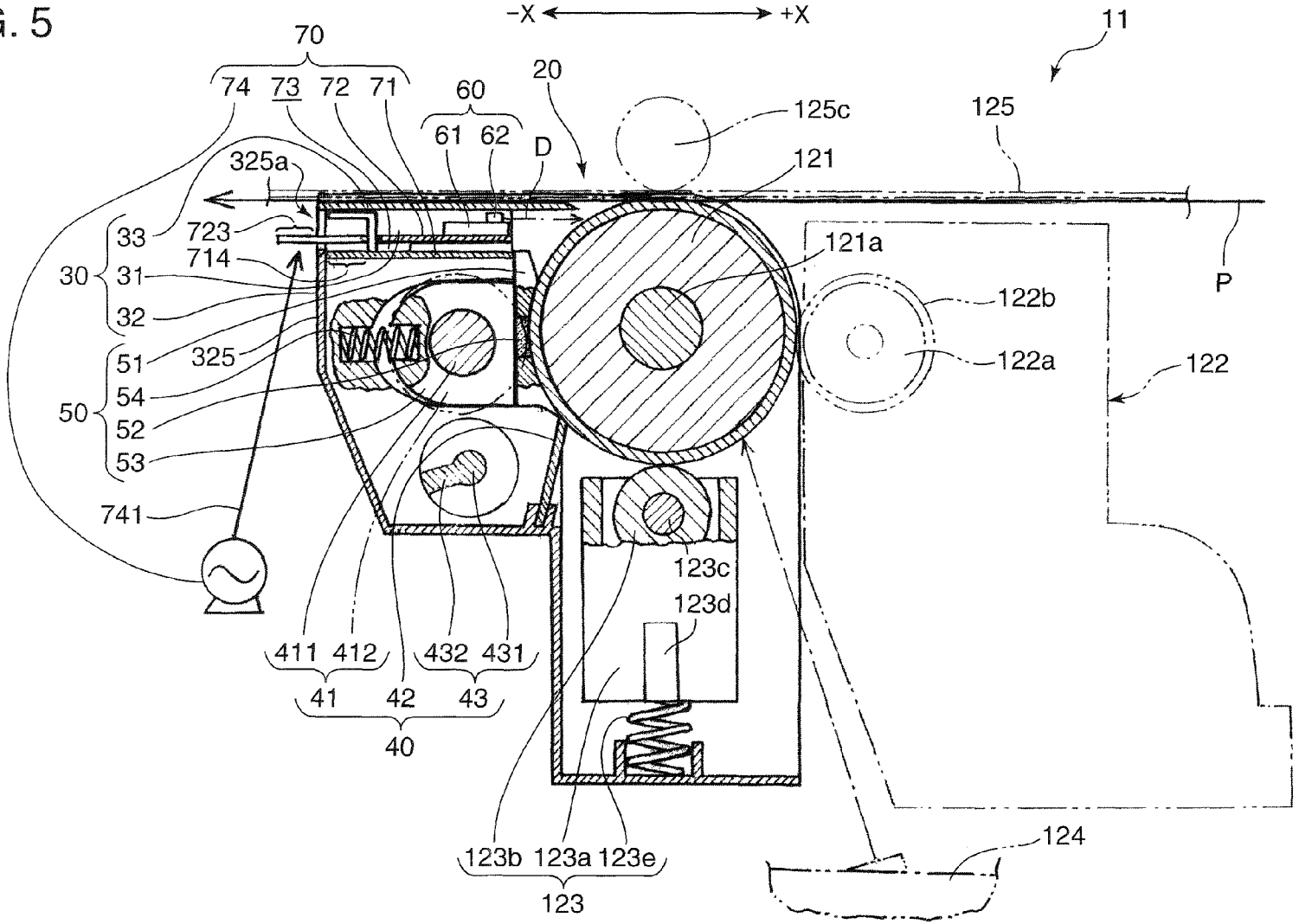

FIG. 3 is an exploded perspective view, partly cut away, as a principle diagram showing one embodiment of the drum unit 20. FIG. 4 is an assembled perspective view of the drum unit 20. FIG. 5 is a cross-sectional diagram along V-V of FIG. 4. In FIGS. 3 to 5, direction indication by X and Y is the same as in the case of FIG. 1 (−X: leftward, +X: rightward, −Y: forward, +Y: backward).

As shown in FIGS. 3 to 5, the drum unit 20 is formed by mounting the photoconductive drum 121, the charger 123, the drum cleaner 40, the lubricant applicator 50, the neutralizers 60 and the cooling structure 70 in a housing 30. The housing 30 includes a pair of front and rear side plates 31 having a vertically inverted L-shape when viewed from front in −Y direction, a connecting plate 32 connecting the left sides of this pair of side plates 31 and a ceiling plate 33 connecting the upper sides of the pair of side plates 31.

Each side plate 31 is comprised of a vertically extending plate 311 and a horizontally extending plate 312 extending to the left from a substantially upper half of the vertically extending plate 311. A drum shaft fitting hole 313 is perforated at a right-upper position of each side plate 31, into which a drum shaft 121*a* of the photoconductive drum 121 is fittable.

On facing surfaces of the horizontally extending plates 312 of the respective side plates 31, thickened portions 314 are formed to bulge out in facing directions to have a specified thickness. Each thickened portion 314 is formed with a mounting recess 315 by making a leftward extending cut in the right end surface. Movable brackets 53 to be described later are so fitted into these mounting recesses 315 as to be laterally movable. Meanwhile, "laterally" means "in a direction from a left side to a right side, or "in a direction from a right side to a left side"

A laterally long oblong hole 316 is perforated at a position corresponding to the mounting recess 315 of the thickened portion 314 in the horizontally extending plate 312 of the rear side plate 31.

A roller shaft 411 to be described later is so fitted into this oblong hole 316 as to be slightly laterally movable.

Vertically extending mounting grooves 317 are formed in substantially lower halves of facing surfaces of the vertically extending plates 311 of the pair of side plates 31. A pair of front and rear ribs 123*d* of the charger 123 to be described later are fitted into these mounting grooves 317.

The charger 123 includes a casing 123*a* in the form of a rectangular parallelepiped having an open upper surface and a length slightly shorter than an inner dimension between the respective vertically extending plates 311 of the pair of side plates 31, and a charging roller 123*b* housed in this casing 123*a* in the state that an upper part of the charging roller 123*b* projects upward from a opening of the casing 123*a*, and extending in forward and backward directions. The charging roller 123*b* is supported rotatably about a roller shaft 123*c* extending between the front and rear side plates of the casing 123*a*. A voltage is applied from an unillustrated power supply device to the charging roller 123*b*, whereby the circumferential surface of the photoconductive drum 121 held in contact with the circumferential surface of the charging roller 123*b* is charged.

The ribs 123*d* fittable into the respective mounting grooves 317 formed in the facing surfaces of the respective vertically extending plates 311 of the housing 30 while being held in sliding contact therewith are provided on the front and rear side plate of the casing 123*a*. Accordingly, by fitting the respective ribs 123*d* into the corresponding mounting grooves 317, the charger 123 can be vertically moved while the ribs 123*d* are guided by the mounting grooves 317.

A specified number of coil springs 123*e* are provided in a compressed state between a bottom plate 321 of the housing 30 and a bottom plate of the casing 123*a* of the charger 123. Accordingly, the circumferential surface of the charging roller 123*b* is pressed into contact with that of the photoconductive drum 121 by biasing forces of the coil springs 123*e* with the charger 123 mounted between the front and rear side plates 31.

The connecting plate 32 connects the pair of side plates 31 with each other and closes openings at the left and lower sides between the pair of side plates 31. The connecting plate 32 is formed to have such a step shape as to extend along the left and bottom edges of the side plates 31 when viewed from front in −Y direction.

Specifically, the connecting plate 32 is made up of the bottom plate 321 corresponding to the bottom edges of the vertically extending plates 311 of the side plates 31, a lower left plate 322 standing up from the left edge of the bottom plate 321 and corresponding to a part of the side plates 31 below the horizontally extending plates 312, a middle bottom plate 323 extending leftward from the upper edge of the lower left plate 322 along the bottom edges of the horizontally extending plates 312 of the side plates 31, an inclined plate 324 extending from the left edge of the middle bottom plate 323 along oblique parts of the horizontally extending plates 312 of the side plates 31 at the left side, and an upper left plate 325 extending upward from the upper edge of the inclined plate 324.

A cutout window 325*a* long in forward and backward directions is formed by cutting off an upper part of the upper left plate 325 from the upper edge. A cut amount of this cutout window 325*a* from the upper edge of the upper left plate 325 is set such that the bottom edge of the cutout window 325 is at the same height level as the left edge of a plate-like frame 71 to be described later with the connecting plate 32 mounted on the side plates 31.

The housing 30 as shown in FIG. 4 is formed by fixing the connecting plate 32 to the left surfaces of the pair of side plates 31, for example, using unillustrated screws and mounting and fixing the ceiling plate 33 between a pair of later-described third steps 314*c* of the respective thickened portions 314 of the horizontally extending plates 312 of the pair of side plates 31, for example, using screws.

The drum cleaner 40 is for cleaning the circumferential surface of the photoconductive drum 121 by removing extraneous matters such as residual toner remaining on the circumferential surface of the photoconductive drum 121 after the transferring process to the sheet P and nitrogen oxides generated and deposited on the circumferential surface of the photoconductive drum 121 during high voltage application to this circumferential surface by the charger 123.

Such a drum cleaner 40 includes a cleaning roller 41 extending between the respective thickened portions 314 of the pair of side plates 31, a blade 42 disposed at a position right below the cleaning roller 41, and a toner conveyance screw 43 arranged between the blade 42 and the inclined plate 324 of the connecting plate 32 at a position right above the middle bottom plate 32.

The cleaning roller 41 is rotated in a forward direction at a higher speed than the photoconductive drum 121 while the circumferential surface thereof is held in sliding contact with that of the photoconductive drum 121, thereby removing extraneous matters deposited on the circumferential surface of the photoconductive drum 121. Such a cleaning roller 41 includes the roller shaft 411 and a roller body 412 concentrically and integrally rotatably fitted on the roller shaft 411.

In such a cleaning roller 41, the front end of the roller shaft 411 is supported on the movable bracket 53 mounted in the front mounting recess 315 located before this front end and the rear end of the roller shaft 411 penetrates through the movable bracket 53 mounted in the rear mounting recess 315 located behind this rear end. Further, the rear end of the roller shaft 411 passes through the oblong hole 316. The cleaning roller 41 is mounted in the housing 30 in the above state.

The pair of front and rear movable brackets 53 respectively fitted in the front and rear mounting recesses 315 are biased rightward by coil springs 54 to be described later, whereby the circumferential surface of the roller body 412 of the cleaning roller 41 is pressed into contact with that of the photoconductive drum 121. By this, extraneous matters on the circumferential surface of the photoconductive drum 121 are effectively removed. The extraneous matters removed from the circumferential surface of the photoconductive drum 121 are collected into an extraneous matter collecting space 34 enclosed by the pair of horizontally extending plates 312, the middle bottom plate 323, the inclined plate 324 and the blade 42.

The blade 42 is disposed at the position right below the cleaning roller 41 to scrape off the extraneous matters on the circumferential surface of the photoconductive drum 121 that could not be removed by the drum cleaner 40. Such a blade 42 is long in forward and backward directions (specifically has the same length as an inner dimension between the front and rear thickened portions 314). The blade 42 is inclined upward toward the right so that the leading end thereof reaches the circumferential surface of the photoconductive drum 121 as shown in FIG. 5 with the base end thereof fixed to the right end edge of the middle bottom plate 323 of the connecting plate 32.

Accordingly, the photoconductive drum 121 is rotated about the drum shaft 121*a* in a counterclockwise direction in FIG. 5, whereby extraneous matters such as residual toner and nitrogen oxides that could not be removed by the cleaning roller 41 and adhere to the circumferential surface of the photoconductive drum 121 are scraped off by the leading end (upper end) of the blade 42. In this way, an image formation area of the photoconductive drum 121 is cleaned. The extraneous matters scraped off from the circumferential surface of the photoconductive drum 121 are collected into the extraneous matter collecting space 34.

The toner conveyance screw 43 discharges collected matters such as residual toner collected into the extraneous matter collecting space 34 to the outside. The toner conveyance screw 43 includes a screw shaft 432 extending between and penetrating through the respective thickened portions 314 of the pair of side plates 31, and a spiral screw fin 432 concentrically and integrally rotatably fitted on the screw shaft 431 to carry the collected matters out by the rotation about the screw shaft 431.

On the other hand, an insertion hole 318, into which the rear end of the roller shaft 411 is inserted, is perforated in the thickened portion 314 of the rear side plate 31, and a discharging tube body 35 for discharging the collected matters to an outer side (front side) is provided on the thickened portion 314 of the front side plate 31. The front end of the toner conveyance screw 43 is inserted into this discharging tube body 35 and a discharge port 351 is formed at a specified position at the lower side of the discharging tube body 35.

A specified shutter member 36 formed by combining a shutter mechanism, a spring and the like is mounted on the discharging tube body 35. By mounting the drum unit 20 into the apparatus body 11, the shutter member 36 interferes with a specified member in the apparatus body 11 to open the discharge port 351. On the other hand, by pulling the drum unit 20 out from the apparatus body 11, the interference between the specified member in the apparatus body 11 and the shutter member 36 is canceled to close the discharge port 351.

The photoconductive drum 121, the cleaning roller 41 and the toner conveyance screw 43 are linked with each other via unillustrated gears disposed between the drum shaft 121*a*, the roller shaft 411 and the screw shaft 431.

Accordingly, when a driving force of an unillustrated drive motor is, for example, transmitted to the drum shaft 121*a* to rotate the photoconductive drum 121 in the counterclockwise direction of FIG. 5, this torque is transmitted to the cleaning roller 41 as a torque acting in a clockwise direction of the cleaning roller 41 whose circumferential speed is set to be faster than that of the photoconductive drum 121. Further, a torque of the photoconductive drum 121 is transmitted to the toner conveyance screw 43 as a torque acting in a specified direction of the toner conveyance screw 43.

The lubricant applicator 50 is for applying the lubricant to the circumferential surfaces of the opposite end portions of the photoconductive drum 121 lying outside the image formation area. The lubricant is applied to the circumferential surfaces of the opposite end portions of the photoconductive drum 121 for the following reason. Specifically, the circumferential surfaces of the opposite end portions of the photoconductive drum 121 lie outside the image formation area and, accordingly, residual toner is unlikely to adhere thereto. Thus, these circumferential surfaces are not cleaned by the drum cleaner 40.

However, gap rollers 122*b* provided to form a specified clearance (gap) between the circumferential surface of a developing roller 122*a* of the developing device 122 and that of the photoconductive drum 121 are respectively held in contact with the opposite end portions of the photoconductive drum 121 as shown in FIGS. 4 and 5. Accordingly, if foreign matters such as residual toner and nitrogen oxides scattered to the opposite end portions of the photoconductive drum 121 attach to and deposit on the opposite end portions of the photoconductive drum 121, the gap rollers 122*b* run onto and, then, run off from the attached and deposited foreign matters as the photoconductive drum 121 is rotated, whereby the developing device 122 swings.

If the developing device 122 swings, a strictly dimensioned gap size between the circumferential surface of the photoconductive drum 121 and that of the developing roller 122*a* changes. If the gap size changes, the toner cannot be supplied from the circumferential surface of the developing roller 122*a* toward that of the photoconductive drum 121 in a stable state, with the result that no proper toner image is formed on the circumferential surface of the photoconductive drum 121, i.e. a so-called image failure occurs.

In order to eliminate such an image failure, the lubricant is applied to the circumferential surfaces of the opposite end portions of the photoconductive drum 121, whereby the frictional resistance of these parts is reduced to make these parts highly lubricant and the adhesion of foreign matters is prevented.

In this embodiment, as shown in FIG. 3, such a lubricant applicator 50 includes side sealing members 51 held in contact with the circumferential surfaces of the opposite end portions of the photoconductive drum 121 while holding lubricants 52, the movable brackets 53 having the side sealing members 51 adhered to the right end surfaces thereof and functioning also as bearings for the roller shaft 411, and the coil springs 54 for biasing the movable brackets 53 toward the photoconductive drum 121.

Although the side sealing members 51 are members for supporting the lubricants 52 in this embodiment, they are originally used to prevent the toner from leaking from the circumferential surface of the photoconductive drum 121.

Figure 6A:
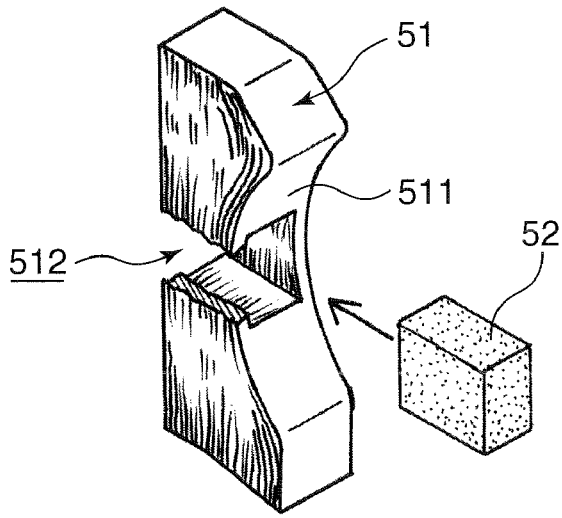
FIG. 6A shows a state immediately before a lubricant is mounted in the side sealing member and FIG. 6B shows a state where the lubricant is mounted in the side sealing member.
Figure 6A:
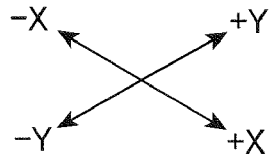
Figure 6B:
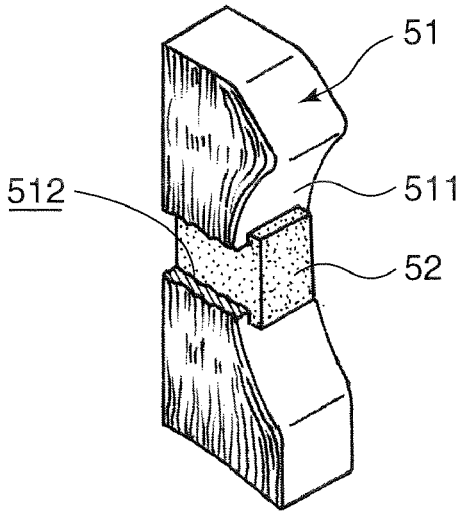

FIGS. 6A and 6B are perspective views, partly cut away, showing one embodiment of the side sealing member 51, wherein FIG. 6A shows a state immediately before the lubricant 52 is mounted into the side sealing member 51 and FIG. 6B shows a state where the lubricant 52 is mounted in the side sealing member 51. Direction indication by X and Y in FIG. 6 is the same as in the case of FIG. 1 (−X: leftward, +X: rightward, −Y: forward, +Y: backward).

As shown in FIG. 6A, the side sealing member 51 is formed by cutting an acrylic pile sealing material formed by laminating a plurality acrylic resin sheets while pressing them by a specified mold. An arcuate edge surface 511 to be held in sliding surface contact with the circumferential surface of the photoconductive drum 121 is formed in the right end surface of such a side sealing member 51. A mount hole 512, into which the lubricant 52 is fitted, is perforated in a central part of this arcuate edge surface 511.

The lubricants 52 are abraded against the circumferential surfaces of the opposite end portions of the photoconductive drum 121 while being fitted in the mount holes 512 of the side sealing members 51 and lubricants solid at ordinary temperature are used as such. The lubricants 52 are shaped identical to the inner shape of the mount holes 512, thereby being closely fitted into the mount holes 512. Since the mount hole 512 is rectangular parallelepipedic in an example shown in FIGS. 6A and 6B, the lubricant 52 is set to have a rectangular parallelepipedic shape in conformity.

Metal salts of fatty acids such as palmitic acids, stearic acids or oleic acids are preferably used as such lubricants 52. Since metal salts of such fatty acids are solid at ordinary temperature like solid soap for domestic use and have slimy surfaces, they are suitable materials to be applied to the circumferential surface of the photoconductive drum 121 by being abraded. Although zinc stearate is used as the lubricants 52 in this embodiment, the lubricants 52 are not limited to zinc stearate and various types of metal salts of fatty acids can be used as such.

Such lubricants 52 are applied to the circumferential surface of the photoconductive drum 121 while being fitted in the mount holes 512 of the side sealing members 51 adhered to the movable brackets 53.

The respective movable brackets 53 are so fitted into the mounting recesses 315 formed in the thickened portions 314 of the respective side plates 31 as to be laterally movable while being held in sliding contact. The coil spring 54 is disposed between the left end surface of the movable bracket 53 and the left end surface of the mounting recess 315. This coil spring 54 presses the movable bracket 53 rightward by its biasing force (see FIG. 5).

Accordingly, the circumferential surface of the roller body 412 is pressed into contact with the image formation area on the circumferential surface of the image formation area of the photoconductive drum 121 via the roller shaft 411 supported on the movable brackets 53. Further, the side sealing members 51 are pressed into contact with the respective circumferential surfaces of the opposite end portions of the photoconductive drum 121 via the movable brackets 53. In this way, the lubricants 52 held in the mounting holes 512 of the respective side sealing members 51 are pressed into contact with the circumferential surfaces of the opposite end portions of the photoconductive drum 121. In this way, when the photoconductive drum 121 is rotated about the drum shaft 121*a*, the lubricants 52 are applied to the circumferential surfaces of the end portions of the photoconductive drum 121.

The neutralizers 60 neutralize electric charges remaining on the circumferential surface of the photoconductive drum 121 after the toner image is transferred to the transfer belt 125 to set the potential to "±0", so that a new proper charging process can be performed. A plurality of neutralizers 60 are juxtaposed in forward and backward directions on a radiator plate 72 to be described later and extending between the pair of side plates 31 above the cleaning roller 41 in the housing 30.

Each of such neutralizers 60 includes a substrate 61 formed with a specified circuit for power supply and an LED (light emitting diode) 62 placed on the substrate 62 for emitting light by power supplied via the substrate 61. Each LED 62 is formed to irradiate light toward a corresponding range of the circumferential surface of the photoconductive drum 121. The circumferential surface of the rotating photoconductive drum 121 thus irradiated with light has electric charges successively neutralized, thereby entering a state where a proper charging process can be performed by the charger 123.

The cooling structure 70 cools the neutralizers 60 to prevent a temperature increase in the housing 30 by the neutralizers 60. The cooling structure 70 is described in detail below with reference to FIGS. 7 and 8 and also other Figures if necessary.

Figure 7:
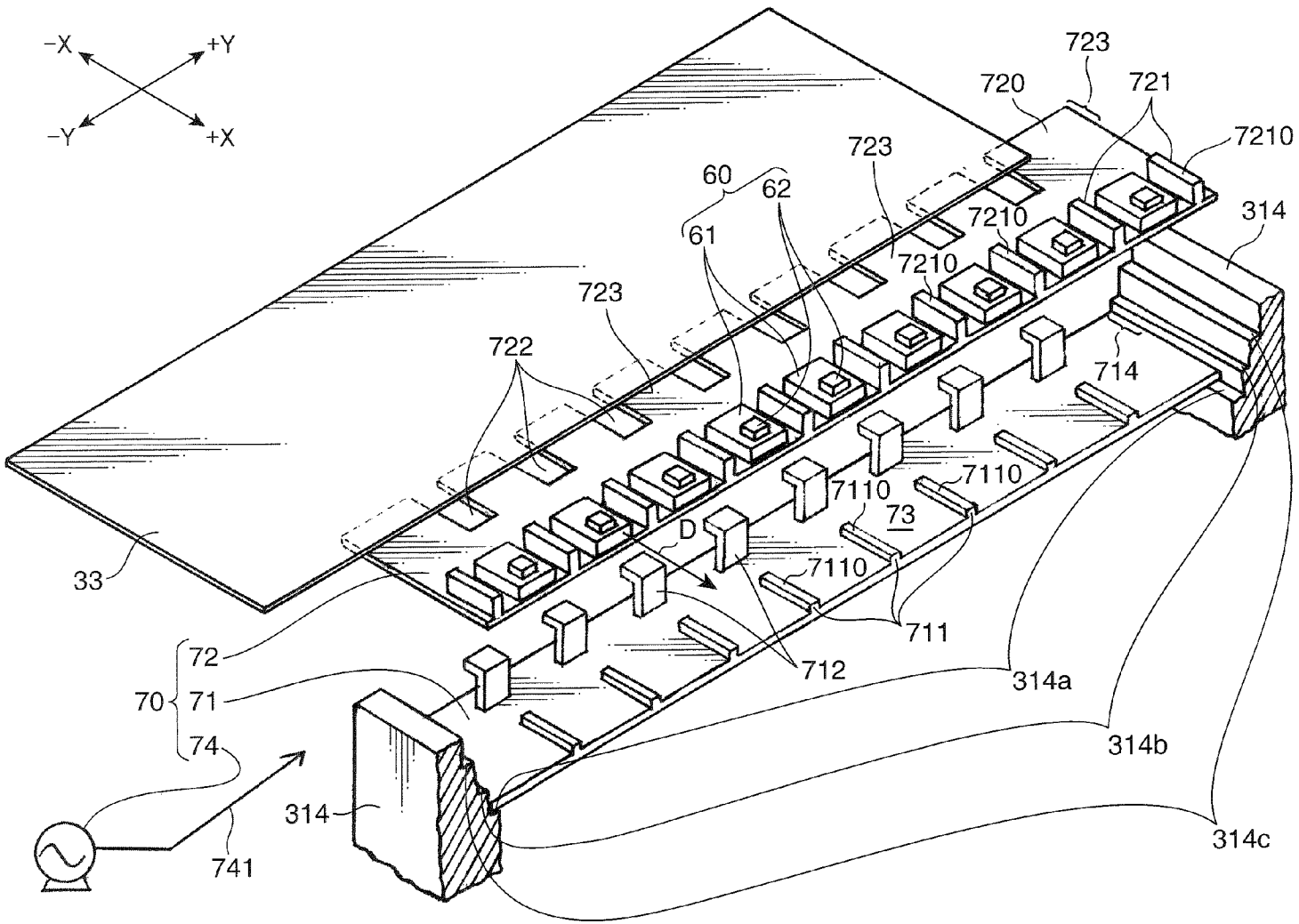
FIG. 7 is an exploded perspective view showing one embodiment of a cooling structure according to the invention.
Figure 8:
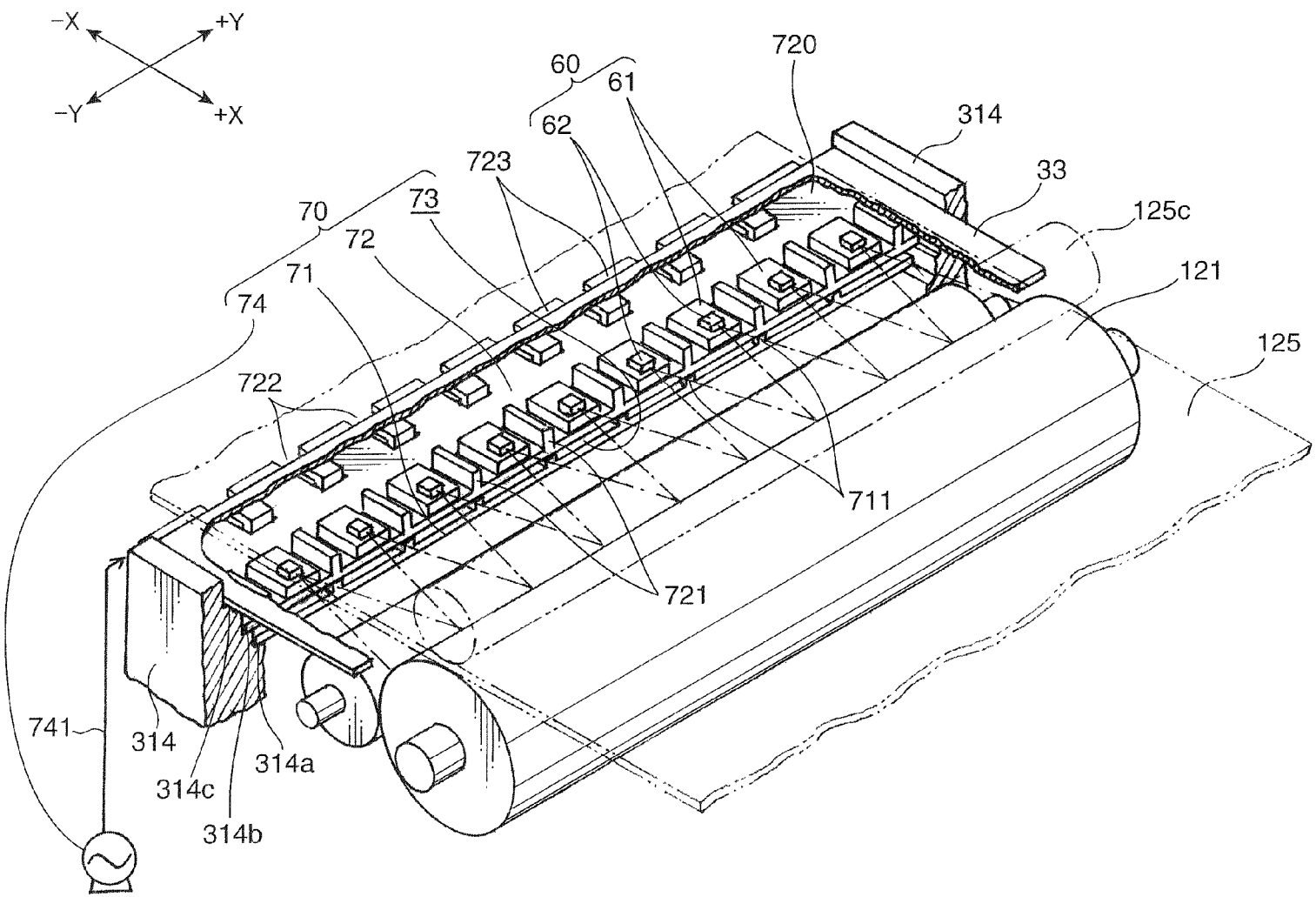
FIG. 8 is an assembled perspective view, partly cut away, showing the cooling structure shown in FIG. 7.

FIGS. 7 and 8 are perspective views showing one embodiment of the cooling structure 70 according to the present invention, wherein FIG. 7 is an exploded perspective view and FIG. 8 is an assembled perspective view, partly cut away. Direction indication by X and Y in FIGS. 7 and 8 is the same as in the case of FIG. 1 (−X: leftward, +X: rightward, −Y: forward, +Y: backward).

First of all, as shown in FIG. 7, the cooling structure 70 includes the plate-like frame 71 extending between the respective thickened portions 314 of the pair of side plates 31 above the cleaning roller 41, the radiator plate 72 having the neutralizers 60 mounted thereon while being supported on the plate-like frame 71 and a cold air fan 74 for supplying an air stream toward this radiator plate 72. The air stream blown toward the radiator plate 72 is also supplied into first clearances (air gaps 73) between the plate-like frame 71 and the radiator plate 72 via the cutout window 325*a* of the upper left plate 325.

On the other hand, first steps 314*a*, second steps 314*b* and third steps 314*c* formed in a staircase pattern and facing each other are respectively formed at positions of the respective thickened portions 314 of the pair of side plates 31 immediately above the cleaning roller 41. The plate-like frame 71 is supported and fixed between the pair of first steps 314*a*, the radiator plate 72 is supported and fixed between the pair of second steps 314*b* and the ceiling plate 33 is supported and fixed between the pair of third steps 314*c*.

A plurality of laterally extending first ribs 711 are arranged side by side at specified intervals in forward and backward directions in the right half of the upper surface of the plate-like frame 71. An upward projecting distance of the respective first ribs 711 is set to a value obtained by subtracting the thickness of the plate-like frame 71 from a vertical dimension between the first and second steps 314*a* and 314*b*. Accordingly, the radiator plate 72 extending between the pair of second steps 314*b* is held in close contact with upper end surfaces 7110 of the respective first ribs 711 of the plate-like frame 71. Strictly speaking, the upper end surfaces 7110 of the respective first ribs 711 are held in close contact with a lower surface 724 (surface different from an upper surface 720 where the neutralizers 60 are arranged) of the radiator plate 72. A plurality of air gaps 73 are formed by the close contact of the radiator plate 72 with the upper end surfaces 7110 of the respective first ribs 711. Thus, heat generated in the neutralizers 60 and transferred to the radiator plate 72 is transferred to the plate-like frame 71 via the respective first ribs 711. The heat transferred to the radiator plate 72 and the plate-like frame 71 is exhausted to the outside of the radiator plate 72 and the plate-like frame 71 by air convection in the air gaps 73.

A plurality of (as many as the first ribs 711 in this embodiment) reinforcing projections 712 which are inverted L-shaped when viewed from front (in −Y direction) are arranged side by side in forward and backward directions at left side positions of the plate-like frame 71. The upper surfaces of such reinforcing projections 712 are located at the same height position as the third steps 314*c*. Accordingly, the ceiling plate 33 extending between the pair of third steps 314*c* is also supported on these reinforcing projections 712 penetrating through the radiator plate 72.

A plurality of laterally extending second ribs 721 are arranged side by side at specified intervals in forward and backward directions in the right half of the upper surface 720 of the radiator plate 72. An upward projecting distance of the respective second ribs 721 is set to a value obtained by subtracting the thickness of the radiator plate 72 from a vertical dimension between the second and third steps 314*b* and 314*c*. Accordingly, the ceiling plate 33 extending between the pair of first steps 314*a* is held in close contact with upper end surfaces 7210 of the respective second ribs 721 of the radiator plate 72. Thus, heat of the radiator plate 72 is transferred to the ceiling plate 33 via the respective second ribs 721.

The neutralizers 60 are mounted between the adjacent second ribs 721 on the upper surface 720 of the radiator plate 72.

The upper end surfaces 7210 of the respective second ribs 721 of the radiator plate 72 are held in close contact with the ceiling plate 33 as described above. Thus, a plurality of second clearances (air gaps) 730 are formed between the radiator plate 72 and the ceiling plate 33 (see FIG. 4). The presence of these air gaps displays the following effects. For example, heat generated in the neutralizers 60 mounted on the radiator plate 72 is transferred to the radiator plate 72. The heat thus transferred from the neutralizers 60 to the radiator plate 72 is further transferred to the ceiling plate 33 via the respective second ribs 721. At this time, the heat of the radiator plate 72 and the ceiling plate 33 is exhausted to the outside of the radiator plate 72 and the ceiling plate 33 by the convection of air layers in the air gaps 730.

As shown in FIG. 7, a plurality of notched grooves 722 corresponding to the reinforcing projections 712 and permitting the reinforcing projections 712 to penetrate therethrough and radiating pieces 723 located between the adjacent notched grooves 722 and made of a left end part extending in a leftward direction (−X direction) of the apparatus body 11 are respectively formed at left positions of the radiator plate 72. The width of the respective notched grooves 722 is set to be slightly larger than a dimension of the reinforcing projections 712 in forward and backward directions, whereby the respective notched grooves 722 can be fitted around the corresponding reinforcing projections 712.

The aforementioned plate-like frame 71 includes a left end part 714 extending in the leftward direction (−X direction) of the apparatus body 11 as shown in FIG. 7. A positional relationship between the left end part 714 of the plate-like frame 71 and the radiating pieces 723 of the radiator plate 72 is defined as follows. Specifically, as shown in FIGS. 3, 5 and 7, the radiating pieces 723 of the radiator plate 72 project more leftward than the left end part 714 of the plate-like frame 71.

By locating the radiating pieces 723 of the radiator plate 72 more leftward than the left end part 714 of the plate-like frame 71 in this way, the radiating pieces 723 of the radiator plate 72 are located more outward (leftward of the apparatus body 11) than the left end part 714 of the plate-like frame 71.

In FIG. 8 is shown a state where the plate-like frame 71, the radiator plate 72 and the ceiling plate 33 are mounted between the respective thickened portions 314 of the pair of side plates 31. Such a state is obtained by the following procedure.

First of all, as shown in FIG. 7, the plate-like frame 71 is mounted and fixed between the pair of first steps 314*a* of the thickened portions 314. Thereafter, the radiator plate 72 mounted with the neutralizers 60 is mounted and fixed between the pair of second steps 314*b*. At this time, the reinforcing projections 712 of the frame 71 are held in contact with the back sides of the notched grooves 722 of the radiator plate 72 (backmost parts of the notched grooves 722). Finally, the ceiling plate 33 is mounted and fixed between the pair of third steps 314*c*.

With the radiator plate 72 mounted between the pair of thickened portions 314, the radiating pieces 723 project out through the cutout window 325*a* of the upper left plate 325 of the connecting plate 32 as shown in FIG. 5.

FIG. 5 shows a state where the plate-like frame 71, the radiator plate 72 and the ceiling plate 33 are mounted in the housing 30. As shown, the right ends of the plate-like frame 71 and the radiator plate 72 are located at the same position in the lateral direction of the apparatus body 11. On the other hand, the radiating pieces 723 of the radiator plate 72 project more in the leftward direction of the apparatus body 11 than the left end part 714 of the plate-like frame 71. As shown, the radiating pieces 723 project through the cutout window 325*a* of the upper left plate 325 of the connecting plate 32.

Here, the connecting plate 32 formed with the cutout window 325*a* forms a wall surface of the housing 30, for example, as is also clear from FIG. 4 or 5. Thus, the radiating pieces 723 projecting through the cutout window 325*a* can be said to project from the wall surface of the housing 30. Therefore, the radiating pieces 723 can project out from the housing 30 by projecting through the cutout window 325*a*.

The cold air fan 74 is disposed at a suitable position in the apparatus body 11 and sends air taken in from the outside of the apparatus body 11 through a specified duct 741 and blows the air toward the radiating pieces 723 of the radiator plate 72 from a specified nozzle. The remainder of the air sent and blown to the radiating pieces 723 by the cold air fan 74 is also supplied into the air gaps 73 through the cutout window 325*a*. By the air (cold air) supplied into the air gaps 73, air (hot air) generated from the plate-like frame 71 and the radiator plate 72 is heat exchanged with the air (cold air) supplied into the air gaps 73. By this heat exchange, the heat generated by the neutralizers 60 is effectively removed by the blown air from the cold air fan 74, wherefore the conventional problem that the temperature increases of the neutralizers 60 adversely affect the image forming process can be reliably solved.

As described above, the image forming apparatus 10 according to the present invention is provided with the developing device 122 for forming a toner image corresponding to specified image information on the rotating photoconductive drum 121 for bearing the toner image, the neutralizers 60 for neutralizing electric charges on the photoconductive drum 121 by light irradiation after the toner image on the photoconductive drum 121 is transferred to a specified transfer material, and the plate-like frame 71 for supporting the neutralizers 60. The air gaps (first clearances) 73 including air layers as one of the constituent elements of the cooling structure 70 according to the present invention are formed between the neutralizers 60 and the plate-like frame 71.

According to such a construction, heat generated by power application to the neutralizers 60 is transferred to the air layers in the air gaps 73 formed between the neutralizers 60 and the plate-like frame 71 supporting the neutralizers 60 and exhausted by the convection of the air layers. Thus, temperature increases of the neutralizers 60 and surrounding devices can be more effectively suppressed as compared with the case where the entire lower surfaces of the neutralizers 60 are merely supported in close surface contact with the plate-like frame 71 and the neutralizers 60 are cooled only by heat transfer.

Accordingly, the occurrence of such an inconvenience where low melting-point toner scattered and attached to devices surrounding the neutralizers 60 is melted due to the temperature increases of the neutralizers 60 and then solidified, thereby causing these devices to be no longer normally driven, and a proper image forming process cannot be ensured is effectively prevented. As a result, a high quality image with high reliability can be formed.

Since the neutralizers 60 are supported on the plate-like frame 71 via the radiator plate 72 and the air gaps 73 are formed between the plate-like frame 71 and the radiator plate 72, heat generated in the neutralizers 60 is temporarily transferred to the radiator plate 72 supporting the neutralizers 60. The heat transferred to the radiator plate 72 is successively exhausted to the outside by air convention produced inside and outside the air gaps 73 formed between the radiator plate 72 and the plate-like frame 71, whereby the neutralizers 60 can be more effectively cooled.

Further, the radiator plate 72 includes the radiating pieces 723 made of the left end part located more outward than the end part of the plate-like frame 71. Thus, the heat radiation area of the radiator plate 72 is increased by the radiating pieces 723 formed at the outer side of the plate-like frame 71, with the result that a cooling effect can be further improved.

Since the cold air fan 74 is provided to supply cold air to the radiator plate 72, the heat of the radiator plate 72 is forcibly removed by the cold air from the cold air fan 74. Therefore, the neutralizers 60 can be more efficiently cooled.

The present invention is not limited to the above embodiment and can also contain the following contents.

(1) Although the copier is taken as an example of the image forming apparatus 10 employing the lubricant applicator 50 in the above embodiment, the image forming apparatus 10 may be a printer or a facsimile machine without being limited to the copier.

(2) Although the cold air fan 74 is employed as the cooling structure 70 in the above embodiment, it is also possible to ensure an effective cooling effect for the neutralizers 60 by providing the air gaps 73 even without particularly employing the cold air fan 74 depending on the situation.

(3) Although the photoconductive drum 121 is taken as an example of the image bearing member in the above embodiment, the image bearing member may be an endless belt without being limited to the photoconductive drum 121.

(4) Although the LEDs 62 are employed as members of the neutralizers 60 for irradiating light to the photoconductive drum 121 in the above embodiment, ordinary lamps for emitting light by power application may be employed instead of the LEDs 62.

In the construction of the above specific embodiment, it is preferable to further include a radiator plate for receiving heat generated in a neutralizer and radiating the received heat and to support the neutralizer on the frame via the radiator plate.

According to this construction, the heat generated in the neutralizer is temporarily transferred to the radiator plate and successively exhausted to the outside by air convection produced inside and outside of a first clearance formed between the radiator plate and the frame, wherefore the neutralizer is more effectively cooled.

In the above construction, it is preferable that the neutralizer is mounted on one surface of the radiator plate; that the frame includes a first rib having an upper end surface held in close contact with the other surface of the radiator plate; and that the first clearance is formed by the close contact of the upper end surface of the first rib with the other surface of the radiator plate.

According to this construction, the heat generated in the neutralizer and transferred to the radiator plate is transferred to the plate-like frame via the first rib. The heat transferred to the radiator plate and the frame is exhausted to the outside of the radiator plate and the frame by air convection in the first clearance formed by the close contact of the upper end surface of the first rib with the radiator plate. Thus, temperature increases of the neutralizer and its surrounding devices are more effectively suppressed.

In the above construction, it is preferable that a ceiling plate to which the heat is transferred from the radiator plate is further provided; that the neutralizer is mounted on the radiator plate; and a second clearance is formed between the radiator plate and the ceiling plate.

According to this construction, the heat generated in the neutralizer and transferred to the radiator plate is further transferred to the ceiling plate. The heat transferred to the radiator plate and the ceiling plate is exhausted to the outside of the radiator plate and the ceiling plate by air convection in the second clearance formed between the radiator plate and the ceiling plate. Thus, temperature increases of the neutralizer and its surrounding devices are more effectively suppressed.

In the above construction, it is preferable that a ceiling plate to which the heat is transferred from the radiator plate is further provided; and that the radiator plate has the neutralizer mounted on one surface thereof and includes a second rib held in close contact with the ceiling plate.

According to this construction, the heat generated in the neutralizer and transferred to the radiator plate is further transferred to the ceiling plate via the second rib. Thus, temperature increases of the neutralizer and its surrounding devices are more effectively suppressed.

In the above construction, the radiator plate preferably includes an end part located more outward than an end part of the frame.

According to this construction, the heat radiation area of the radiator plate is increased by including the end portion located more outward than the end part of the frame and a heat radiation effect is improved by that much, and the cooling effect is further improved by the contact of the part located more outward than the end part of the frame with outside air.

In the above construction, the radiator plate preferably includes radiating pieces made by the end part located more outward than the end part of the frame.

According to this construction, the heat radiation area of the radiator plate is increased by including the radiating pieces located more outward than the end part of the frame and the heat radiation effect is improved by that much, and the cooling effect is further improved by the contact of the radiating pieces located more outward than the end part of the frame with outside air.

In the above construction, it is preferable that a housing accommodating the neutralizer, the frame and the radiator plate is further provided; and that an end part of the radiator plate located more outward than an end part of the frame projects out from the housing.

According to this construction, even if temperature in the housing increases due to the heat generated by the neutralizer, the heat transferred to the radiator plate is released to the outside of the housing by the end part projecting to the outside of the housing having a lower temperature than in the housing. Thus, the effect of the radiator plate to radiate the heat generated by the neutralizer is further improved.

In the above construction, it is preferable to further comprise a cold air supplier for supplying cold air to the radiator plate. Further, it is preferable to comprise a cold air supplier for supplying cold air to the radiating pieces.

According to these construction, the heat of the radiator plate (radiating pieces) is forcibly removed by the contact of cold air with the radiator plate (radiating pieces), wherefore the neutralizer is cooled with high efficiency via the radiator plate (radiating pieces) cooled by the cold air.

In the above construction, the cold air supplier preferably further supplies the cold air in a direction toward the first clearance.

According to this construction, the cold air enters the first clearance since it is supplied in the direction toward the first clearance. Hot air generated from the frame and the radiator plate is heat exchanged with the cold air by the cold air having entered the first clearance. By this heat exchange, the heat generated in the neutralizer is effectively removed.

An image forming unit according to another aspect of the present invention comprises an image bearing member which is a photoconductive drum having an image formation area on the circumferential surface thereof and rotatable about a shaft center; a neutralizer for neutralizing electric charges on the image bearing member by irradiating light to the charged image bearing member after a toner image formed on the image bearing member is transferred to a transfer material; and a frame for supporting the neutralizer, wherein a first clearance is present between the neutralizer and the frame, and at least the image bearing member, the neutralizer and the frame are unitized.

According to this construction, heat generated by power application to the neutralizer is transferred to an air layer in the first clearance present between the neutralizer and the frame supporting the neutralizer and removed by the convention of the air layer. Thus, temperature increases of the neutralizer and its surrounding devices are more effectively suppressed as compared with the case where the entire lower surface of the neutralizer is merely supported in close surface contact with the frame and the neutralizer is cooled only by heat transfer.

This application is based on Japanese Patent application serial No. 2008-218230 filed in Japan Patent Office on Aug. 27, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image bearing member for bearing a toner image while rotating;

a toner image forming device for forming the toner image on the image bearing member;

a neutralizer for neutralizing electric charges on the image bearing member by irradiating light to the charged image bearing member after the toner image formed on the rotating image bearing member is transferred to a transfer material, and a frame for supporting the neutralizer, wherein a first clearance is present between the neutralizer and the frame to define at least one first air gap, whereby heat generated in the neutralizer is transferred by convection to air in the first air gap.

2. An image forming apparatus according to claim 1, further comprising a radiator plate for receiving heat generated in the neutralizer and radiating the received heat, wherein the neutralizer is supported on the frame via the radiator plate.

3. An image forming apparatus according to claim 2, wherein:

the radiator plate has first and second surfaces;

the neutralizer is mounted on the first surface of the radiator plate;

the frame includes a first rib having an upper end surface held in close contact with the second surface of the radiator plate; and the first clearance is formed by the close contact of the upper end surface of the first rib with the second surface of the radiator plate.

4. An image forming apparatus according to claim 2, further comprising a ceiling plate to which the heat is transferred from the radiator plate, wherein:

the neutralizer is mounted on the radiator plate; and a second clearance is formed between the radiator plate and the ceiling plate.

5. An image forming apparatus according to claim 2, further comprising a ceiling plate to which the heat is transferred from the radiator plate, wherein the radiator plate has first and second surfaces, the frame includes a first rib having an upper end surface held in close contact with the second surface of the radiator plate, the radiator plate has the neutralizer mounted on the first surface thereof and includes a second rib held in close contact with the ceiling plate.

6. An image forming apparatus according to claim 2, wherein the radiator plate includes an end part located more outward than an end part of the frame.

7. An image forming apparatus according to claim 6, wherein the radiator plate includes radiating pieces made by the end part located more outward than the end part of the frame.

8. An image forming apparatus according to claim 6, further comprising a housing accommodating the neutralizer, the frame and the radiator plate, wherein the end part of the radiator plate located more outward than the end part of the frame projects out from the housing.

9. An image forming apparatus according to claim 2, further comprising a cold air supplier for supplying cold air to the radiator plate.

10. An image forming apparatus according to claim 7, further comprising a cold air supplier for supplying cold air to the radiating pieces.

11. An image forming apparatus according to claim 9, wherein the cold air supplier further supplies the cold air in a direction toward the first clearance.

12. An image forming apparatus according to claim 1, wherein the frame includes at least one first rib, the neutralizer being supported on the rib of the frame and the first clearance being defined adjacent the rib.

13. An image forming apparatus according to claim 12, wherein the at least one first rib comprises a plurality of first ribs, the first clearance being formed between the first ribs.

14. An image forming apparatus according to claim 13, further comprising a ceiling plate on a side of the neutralizer opposite the frame, at least one second rib extending to the ceiling plate from a location in proximity to the neutralizer to define at least one second air gap, whereby heat generated in the neutralizer further is transferred by convection to air in the second air gap.

15. An image forming apparatus according to claim 1, further comprising a ceiling plate on a side of the neutralizer opposite the frame, at least one second rib extending to the ceiling plate from a location in proximity to the neutralizer to define at least one second air gap, whereby heat generated in the neutralizer further is transferred by convection to air in the second air gap.

* * * * *